US005362082A

United States Patent [19]

Kornberg

[11] Patent Number: 5,362,082

[45] Date of Patent: Nov. 8, 1994

[54] ADJUSTABLE LATERAL THORACIC SUPPORT FOR A SOLID BACK OF A WHEELCHAIR

[76] Inventor: Gary Kornberg, 19 Kathleen Dr. East, Syosset, N.Y. 11791

[21] Appl. No.: 65,487

[22] Filed: May 24, 1993

[51] Int. Cl.[5] ..... A61G 5/14

[52] U.S. Cl. ..... 280/304.1; 5/623; 5/624; 248/285

[58] Field of Search ..... 280/304.1, 250.1; 297/DIG. 4, DIG. 10; 5/623, 624; 248/285

[56] References Cited

U.S. PATENT DOCUMENTS 5,074,574 12/1991 Carwin ..... 280/304.1

*Primary Examiner*—Mitchell J. Hill

[57] ABSTRACT

The adjustable lateral support for a wheelchair includes a slotted block body housing member fastened to the solid back of a wheelchair. The slotted block body cooperates with a spring loaded locking pin that engages a sliding multiaxis, multiholed hinged bracket. The slotted block body also provides a track for adjustments of the bracket in medial and lateral directions along with placement in specific vertical positions on the solid back. Release of the spring loaded locking pin permits engagement into the multiholed bracket and locks it into place in the slotted block body. Pulling the spring loaded locking pin out of the multiholed angle bracket permits it to slide into a new position into the slotted block housing member or enables the angle bracket to be completely removed. The multiholed angle bracket is sectioned into two parts and connected together by a locking hinge joint. A support pad attached to a most distal end of the bracket can thus rotate away from a midline orientation. The adjustments in lateral and medial directions, the ability for support pads to rotate away from or toward the body or to be completely removed, permits for easy adjustment without tools and unobstructed movement of an occupant into and out of the wheelchair.

20 Claims, 2 Drawing Sheets

ADJUSTABLE LATERAL THORACIC SUPPORT FOR A SOLID BACK OF A WHEELCHAIR

BACKGROUND OF THE INVENTION

This invention pertains to wheelchairs, and more particularly to a lateral thoracic support for a wheelchair, that can be variously positioned in fixed vertical positions, adjust horizontally for changes in clothing thicknesses, breaks away and is removeable for side transfers into and out of the wheelchair.

The utilization of a adjustable lateral thoracic support to a solid back of a wheelchair provides lateral trunk control to maintain upright symmetrical sitting for individuals who have no postural or balance reactions. In cases of neuromuscular dysfunction, with the creation of abnormal muscular tone caused by hypotonicity or hypertonicity along with the lateral forces of gravity on the spine, lateral external control of the thoracic and lumbar spine is of the utmost importance in the prevention of scoliosis, a lateral bony curvature of the spine. Left unsupported, a flexible functional scoliosis can easily become a fixed structural scoliosis impairing symmetrical sitting postures, respiratory function, spinal mobility and placing unequal weight distribution on the ischial tuberosities, the bony prominences of the sitting surfaces of the body.

The existing fixed lateral thoracic supports are limited in their capacity to adapt without tools to changes in clothing thickness during changes in temperature which is needed when one is brought outdoors. Without the ability to accommodate for chest width changes due to coats or jackets, the lateral thoracic supports become too snug for outdoor use. It becomes too time consuming and cumbersome to change the lateral thoracic support chest width with standard fastening devices. Utilizing the quick change feature of this device, accommodation in chest width differences are made easily and without tools.

Moving a non weight bearing individual into and out of a wheelchair is very difficult when fixed non removeable lateral thoracic sub, ports impair side transfers. Another important aspect of this device is its ability to allow the lateral thoracic support to be completely removed from the wheelchair or for the support to completely breakaway from the individual without tools or external devices. This allows for full access to the individual, without creating any excess strain on the attendant performing the side transfer when the individual is moved. It is thus desirable to provide a lateral thoracic support device that controls an unstable trunk in the sit position, allowing for changes in chest width due to clothing variances and is removeable or breaks away for side transfers into and out of the wheelchair beyond that heretofore available among prior art devices.

OBJECTS AND SUMMARY OF THE INVENTION

In order to surpass the limitations of existing devices, among the several objects of the invention are to offer a novel wheelchair lateral thoracic support which is continuously adjustable in both horizontal and vertical planes, rotates breaking away laterally from a midline orientation and is removeable from the wheelchair. Another object of the invention is the unprecedented adjustment without tools, allowing for a quick, easy accommodation for chest width change due to differences in clothing thicknesses. Through the net combination of the aforementioned adjustments, optimal support and ease of adjustment is achieved for an individuals unique requirements.

Briefly described, these and other objects and features of the invention which will be, in part apparent and in part, to be further elucidated in that which follows are accomplished in one embodiment of the invention by which one slotted block housing that is fastened to the solid back of the wheelchair in preset vertical positions allows an angle bracket to slide in a medial or lateral direction when the spring loaded pin that is fastened to it, is removed from the specific holes of adjustment in the bracket. Once engaged, when released, the spring loaded locking pin prevents movement of the bracket and sets it into place. A cushioned support pad is fastened to the angled bracket, contacting the individual at the lateral aspect of the thoracic rib cage. The anterior section of the angle bracket is sectioned into two parts and is connected together by a pin that creates a locking hinge joint. When the distal section of the angle bracket is lifted superiorly, the two flattened surfaces of the hinge joint no longer articulate, allowing the distal section that contains the support pad to rotate in a lateral direction. Conversely, when the most distal section of the locking hinge joint is moved both medial and inferior, the fixed most proximal section of the angle bracket that is fastened to the solid back of the wheelchair locks the distal section into position. A compression spring that the hinge pin passes through at the bottom of the angle bracket elongates, creating a continuous downward force to keep the hinge together.

The padded thoracic support provides for midline orientation in the sit position when the individuals trunk is maintained by this device. This, in turn, maximizes the individuals capacity for upright sitting postures when balance and righting reactions are impaired due to neuromuscular deficits. The individual can now attend to external stimuli in the environment carrying on daily functions in an upright socially accepted fashion. Respiration is enhanced, swallowing and feeding function is facilitated, but most importantly, symmetrical spinal integrity is maintained throughout the day in all environmental conditions.

This invention, accordingly, comprises the constructions hereinafter described, the scope of the invention being indicated in the claims.

DESCRIPTION OF THE DRAWINGS

In the accompanying drawings.

Corresponding reference characters indicate corresponding parts throughout the several views of the drawings.

DETAIL DESCRIPTION OF THE INVENTION

Figure 1:
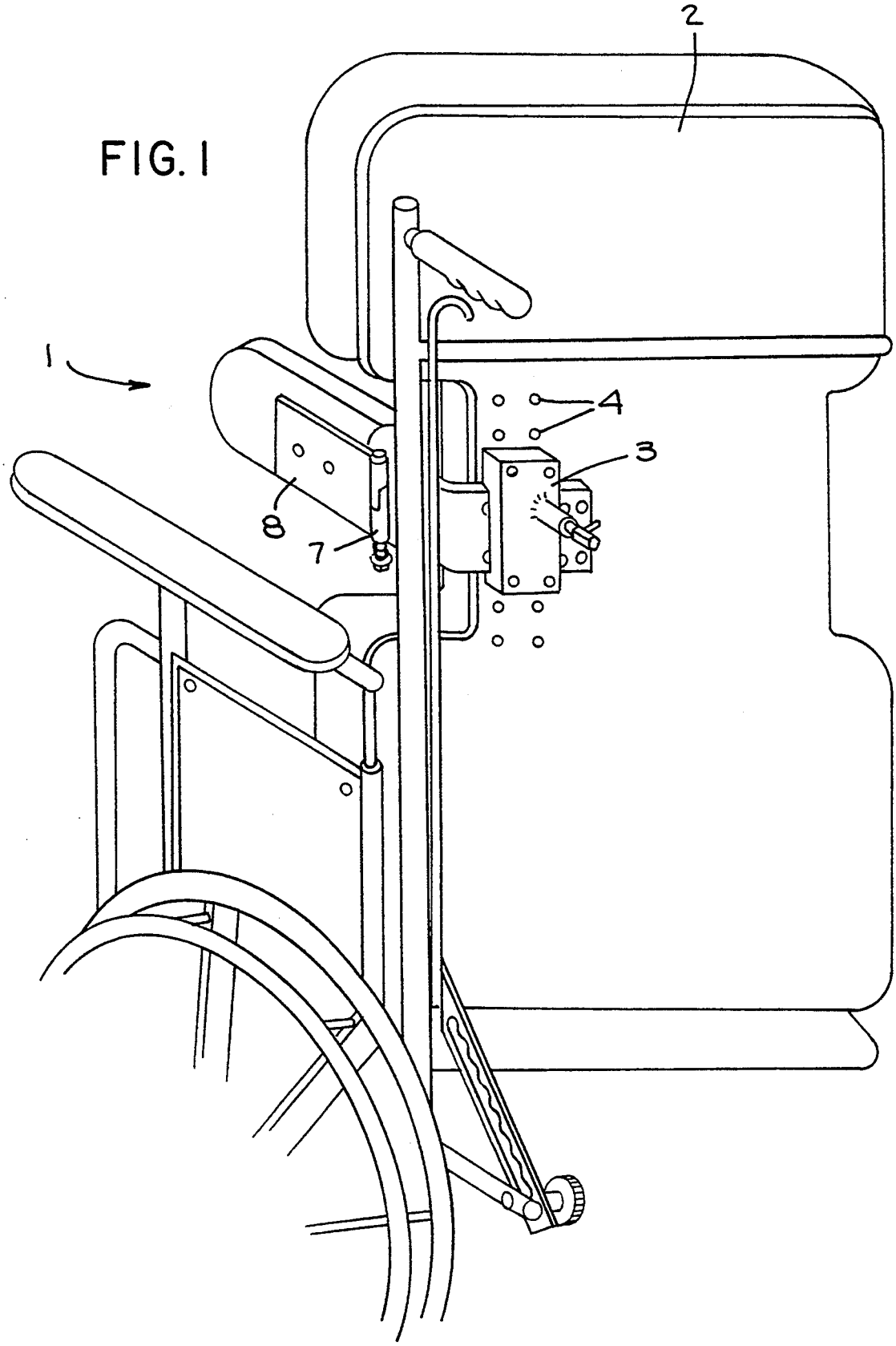
FIG. 1 is a simplified perspective view of an adjustable lateral thoracic support incorporating one embodiment of the invention attached to a solid back of a wheelchair.

A wheelchair incorporating one embodiment of the invention is generally indicated by the reference number 1 in FIG. 1. The solid back 2 which is fastened to the wheelchair backposts provides a place of attachment for the lateral thoracic slotted block housing member 3. Lateral openings are made in the solid back 2 to allow the thoracic supports to pass through to contact the lateral trunk at the thoracic rib cage. Discrete vertical adjustment is achieved when the slotted block housing member 3 is fastened into any of the preset positions 4 in the solid back.

Figure 2:
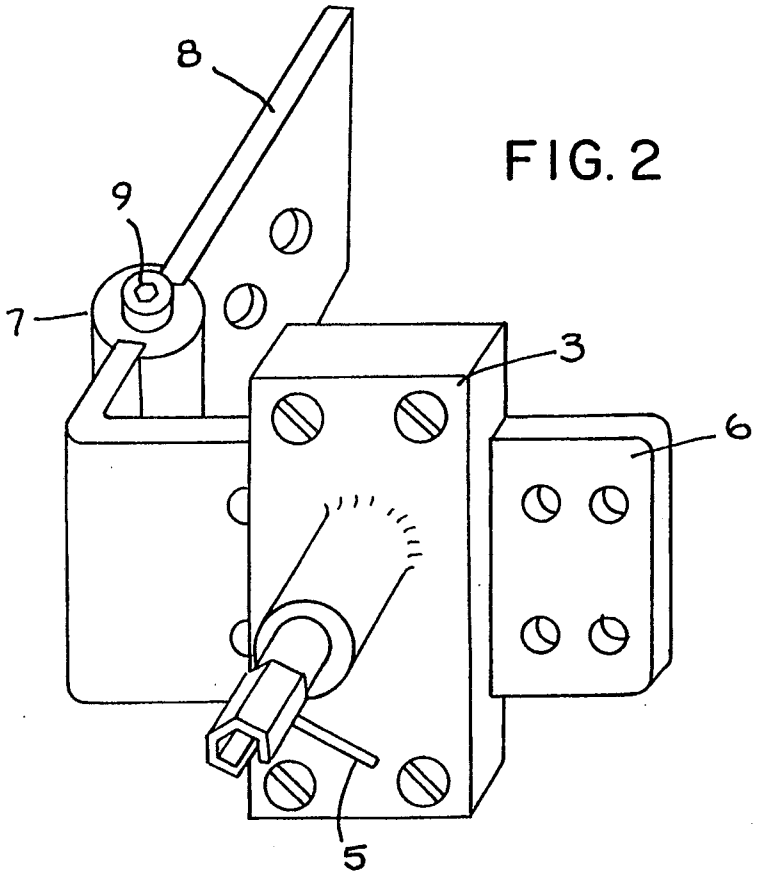
FIG. 2 is a simplified perspective view thereof the adjustable lateral thoracic support separated from the wheelchair.

As illustrated in FIG. 2, the adjustable lateral support includes one slotted block housing member 3, with a fixed spring loaded locking pin 5 that engages the proximal multihole section of the angle bracket 6 permitting medial and lateral adjustment or complete removal when the bracket slides into or away from the trunk when the pin is lifted from the holes. The proximal section of the angle bracket is locked into position when the spring loaded locking pin 5 engages in any of the top holes of the proximal section of the bracket when it is released.

Figure 3:
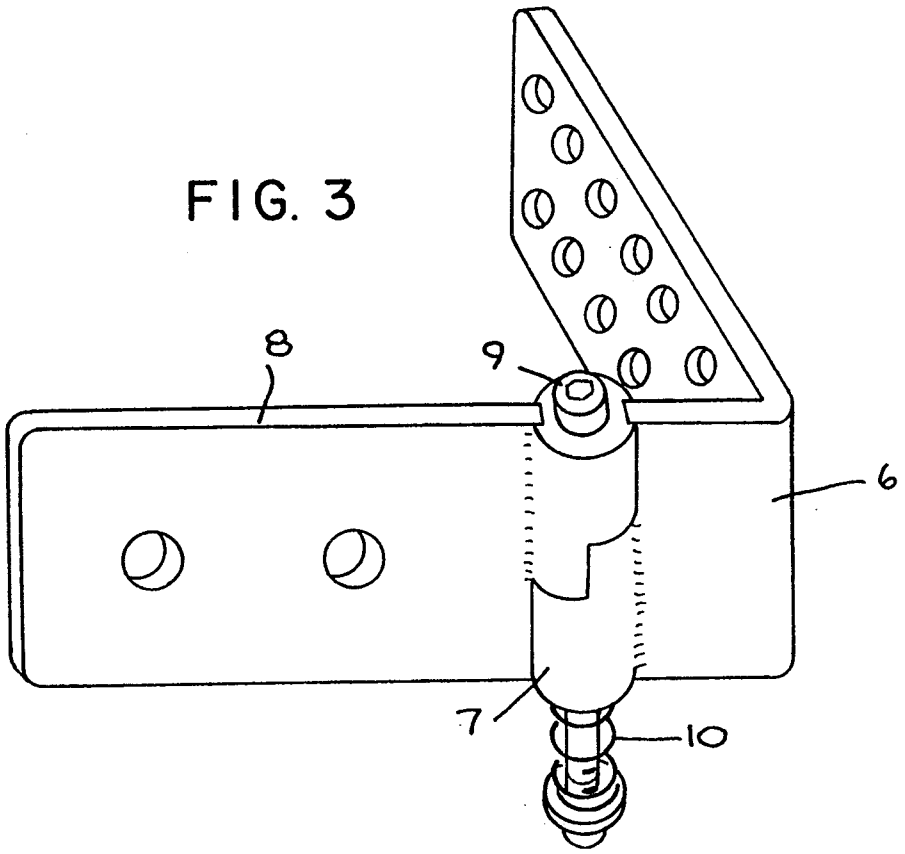
FIG. 3 is a perspective view thereof illustrating the medial—lateral rotation of the lateral support angle bracket and its locking hinge joint.

As illustrated in FIG. 3, the most distal end of the angle bracket proximal section 6 is attached at the inferior end to the multiple axis locking hinge joint 7. The moveable swinging distal end of the angle bracket 8 that contacts the lateral rib cage of the trunk is attached to the superior section of the multiple axis locking hinge joint 7. Both sections of the locking hinge joint are attached together through a bored hole by a pin 9. A compression spring 10 is attached at the bottom of the pin, exerting a continuous downward force on the articulating members on the joint. To rotate the most distal section of the angle bracket away from the trunk of the body, the support is lifted vertically so the flatted surfaces of the joint no longer articulate. This thus permits the breakaway feature of the lateral thoracic support.

Some advantages of the invention evident from the foregoing description include an adjustable lateral thoracic support for a wheelchair that is horizontally adjustable without tools, vertically adjustable in specified increments, breaks away laterally from the trunk by a locking multiaxis articulating hinge joint and is completely removeable.

The resultant versatility in adjustability facilitates optimal positioning of the thoracic trunk, thus enhancing posture and thereby optimizing the level of comfort and support achieveable for the individual. Similarily, there is an enhanced potential to accommodate the widest range of individual needs.

In view of the above, it will be seen that the several objects of the invention are achieved and other advantageous results attained.

As various changes can be made in the above constructions without departing from the scope of the invention, it is intended that all matter contained in the above description or shown in the accompanying drawings shall be interpreted as illustrative and not in a limiting sense.

What is claimed is:

1. An adjustable lateral thoracic support for a wheelchair comprising:

a) a housing member adapted to be secured to a back portion of a wheelchair, b) an angle bracket movable with respect to said housing member to predetermined selected bracket positions, c) first locking means on said housing member for locking said angle bracket in any of said predetermined selected bracket positions, d) said angle bracket having a first leg engageable with said locking means and a second leg disposed at an angle with respect to said first leg, e) pivot means provided on said angle bracket to permit at least a portion of said second leg to pivot to selected predetermined pivot positions with respect to said first leg, and f) second locking means cooperable with said pivot means to lock said second leg into any of said selected predetermined pivot positions.

2. The device as claimed in claim 1 wherein said pivot means is provided on said second leg.

3. The device as claimed in claim 2 wherein said pivot means divides said second leg into a pivoting portion and a non-pivoting portion.

4. The device as claimed in claim 3 wherein said pivoting portion is adapted to support a cushion.

5. The device as claimed in claim 1 wherein said housing member includes a slot sized to receive said first leg, said housing member having opposite lateral sides, said first leg being oriented in said housing member such that said second leg faces one of said lateral sides.

6. The device as claimed in claim 1 wherein said first leg includes openings defining said predetermined selected bracket positions and said first locking means includes a spring-loaded pin biased to engage one of said openings in said first leg, whereby engagement of said pin in said one of said openings locks said angle bracket into one of said predetermined selected bracket positions.

7. The device as claimed in claim 1 wherein said housing member has opposite lateral sides and the first leg of said angle bracket has a free end, said angle bracket being reversibly positionable in said housing member such that the free end of said angle bracket can extend from either one of the lateral sides of said housing member.

8. The device as claimed in claim 1 including a padded thoracic support attachable to said second leg.

9. The device as claimed in claim 1 wherein said housing member includes a track for receiving said angle bracket when said angle bracket is moved to said predetermined selected bracket positions with respect to said housing member.

10. The device as claimed in claim 1 wherein said first locking means has a disengagement position wherein said angle bracket is freely movable relative to said housing member.

11. The device as claimed in claim 10 wherein said angle bracket is removable from said housing member when said first locking means is in said disengagement position.

12. The device as claimed in claim 1 wherein said second leg is pivotable to a position which increases the angle between said first leg and said second leg portion.

13. The device as claimed in claim 1 wherein said second leg is pivotable to a position which decreases the angle between said first leg and said second leg portion.

14. The device as claimed in claim 1 wherein said pivot means and said second locking means constitute a locking hinge.

15. An adjustable lateral thoracic support for a wheelchair comprising:

a) a housing member adapted to be secured to a back portion of a wheelchair, b) arm means movable with respect to said housing member to predetermined selected arm positions, c) first locking means on said housing member for locking said arm means in any of said predetermined selected arm positions, d) said arm means having a first portion pivotable with respect to said housing member, and a second portion that is non-pivotable with respect to said housing member, e) pivot means provided on said arm means to permit said first portion to pivot with respect to said housing member, and f) second locking means cooperable with said pivot means to lock said first portion into a selected predetermined pivot position with respect to said housing member.

16. The device as claimed in claim 15 wherein said arm means includes openings defining said predetermined selected arm positions and said first locking means includes a spring-loaded pin biased to engage one of said openings in said first leg, whereby engagement of said pin in said one of said openings locks said arm means into one of said predetermined selected arm positions.

17. The device as claimed in claim 15 wherein said first portion includes means for supporting a padded thoracic member.

18. The device as claimed in claim 15 wherein said first locking means has a disengagement position wherein said arm means is freely movable relative to said housing member.

19. The device as claimed in claim 18 wherein said arm means is removable from said housing member when said first locking means is in said disengagement position.

20. The device as claimed in claim 15 wherein aid pivot means and said second locking means constitute a locking hinge.

* * * * *